United States Patent [19]

Goltsov et al.

[11] 4,080,224

[45] Mar. 21, 1978

[54] METHOD OF MANUFACTURE OF SEAMLESS CAPILLARY THIN-WALLED VACUUM-TIGHT PIPES FORM PALLADIUM ALLOYS

[76] Inventors: Viktor Alexeevich Goltsov, ulitsa Karpinskogo, 25, kv. 257, Donetsk; Ivan Filippovich Belyaev, ulitsa Sheinkmana, 45, kv. 76, Sverdlovsk; Sergei Grigorievich Guschin, ulitsa Sheinkmana, 45, kv. 148, Sverdlovsk; Nikolai Ivanovich Timofeev, prospekt Lenina, 62, korpus 5, kv. 17, Sverdlovsk; Saule Khuryatbekovna Kurumchina, pereulok Vstrechney, 7, korpus 1, kv. 44, Sverdlovsk, all of U.S.S.R.

[21] Appl. No.: 779,006

[22] Filed: Mar. 18, 1977

[51] Int. Cl.[2] ..... C22C 5/04

[52] U.S. Cl. ..... 148/11.5 R

[58] Field of Search ..... 148/11.5 R, 12.7 R; 75/172 R, 172 G

[56] References Cited

U.S. PATENT DOCUMENTS

| | | | |
|---|---|---|---|
| 3,155,467 | 11/1964 | Yamamoto et al. | 75/172 G |
| 3,172,742 | 3/1965 | Rubin | 75/172 G |
| 3,804,616 | 4/1974 | Goltsov et al. | 75/172 G |

*Primary Examiner*—W. Stallard

*Attorney, Agent, or Firm*—Lackenbach, Lilling & Siegel

[57] ABSTRACT

A pipe billet is drawn and reduced by stages, each time decreasing the cross-sectional area of its walls by 60–80% and annealing it at 830° ± 30° C after each drawing stage. This procedure is continued until the wall thickness of the billet decreases to 0.24 – 0.30 mm; then the billet is again drawn and reduced by stages, each time decreasing the cross-sectional area of the produced pipe by 28 – 50% and annealing the pipe at 750° ± 20° C after each drawing stage.

The method of manufacture of seamless pipes according to the invention allows making capillary thin-walled pipes from palladium-based alloys that will withstand a vacuum of $10^{-3}$ – $10^{-4}$ mm Hg and remain vacuum-tight after 1000 hr of operation in hydrogen-containing media.

1 Claim, No Drawings

METHOD OF MANUFACTURE OF SEAMLESS CAPILLARY THIN-WALLED VACUUM-TIGHT PIPES FORM PALLADIUM ALLOYS

The present invention relates to nonferrous metallurgy and more particularly it relates to the methods of manufacture of seamless pipes from palladium-based alloys.

The seamless capillary thin-walled vacuum-tight pipes from palladium alloys are employed as diffusion membranes selective-permeable for hydrogen and its isotopes and serve as the working elements of diffusion filters for superfine purification of hydrogen isotopes, their separation and/or isolation from gas mixtures.

For these applications said palladium-alloy pipes can be used in the following branches of engineering.

In nonferrous metallurgy, for shielding atmospheres in reducing the oxides of high melting point and rare metals, in the production of semiconductors and hydrides.

In ferrous metallurgy, for producing ultra-pure hydrogen for shielding atmospheres in which stainless and electrical steels are processed.

In chemistry, for separation of gas mixtures, e.g. products of conversion of hydrocarbons and blasting gases in ammonia synthesis.

In food and pharmaceutical industries for hydrogenation of fats and production of medicines.

The present invention will also be useful in solving the problem of protecting the ambient atmosphere. It often happens that the gaseous by-products of production contain hydrogen so that the existing methods of utilization of these gases call for the use of cryogenic engineering at hydrogen temperatures. At the same time, if seamless pipes from palladium alloys are used for diffusion separation of hydrogen from the discharged gases, the process of their further utilization presents no particular difficulties.

To be effective in the above-described applications, the pipes must be seamless, thin-walled, capillary and vacuum-tight.

It is known that the drawing and cold drawing processes can produce pipes ranging in diameter from 1.0 to 150 mm with a wall thickness of, say, 0.1 – 3 mm.

The pipes manufactured by drawing are usually made in several passes or stages since it is impossible to reduce the pipe diameter and wall thickness to any considerable extent in one pass. The pipes are drawn in pipe-drawing mills of various layouts either with or without mandrels (see Ya. L. Vatkin, O. A. Pliatzkovsky, Yu. O. Vaschenko "Seamless pipes", Metallurgizdat Moscow 1963, pp. 137 – 150).

The number of drawing stages of a pipe billet and the degree of its total reduction depend on the plastic properties of the metal in question. As a rule, several drawing stages are followed by annealing the pipes at high temperatures to remove strain-hardening. The annealing temperature depends on the nature of the metal the seamless pipe is being made of. For example, in stainless steel pipes of 0.3 – 0.5 mm diameter with a wall thickness of 0.1 – 0.2 mm the plastic properties of metal permit a total deformation of 36% without interstage heat treatment during the first 12 passes and 56% during the subsequent passes in sink drawing. The temperature of interstage annealing carried out on reaching said degree of deformation ranges from 1000° to 1100° C (see S. S. Shaikevich "Drawing of small pipes" in the collected papers "Pipe production in the Urals", South-Urals Publishing House, Cheliabinsk 1972).

Thus, seamless metal pipes are manufactured by cold drawing and interstage annealing under the conditions depending on the nature of the metal and the contemplated application of seamless pipes.

In French Pat. No. 2.099.979, filed on Apr. 21, 1972 disclosure is made of a method of manufacture of seamless pipes from alloy steels wherein a billet produced on a press is passed through a reducing rolling mill and then drawn on a mandrel.

In French Pat. No. 2147869 filed on Apr. 2, 1973, disclosure is made of a method of manufacturing thick-walled cylinders from aluminum alloys.

A billet in the form of a sleeve or a pipe made from an alloy is cold drawn into a semifinished product whose dimensions correspond to the size of the cylinder side wall after which the cylinder throat is shaped by cold reduction in rolls during several passes with interpass heat treatment consisting of annealing, holding and hardening; then the cylinder is finally machined.

In British patent specificiation No. 1,149,822 filed on Jan. 27, 1967, disclosure is made of a method of rolling pipes from zirconium or zirconium alloys with additions of one or more of the following elements (Sn, Fe, Ni, Cr, Cd). The pipes are manufactured by cold drawing the billets between a pair of grooves of Pilger rolls. The billets are deformed up to 50% on a supporting mandrel. The rolls can either rotate continuously, or oscillate; then the pipe is cold-worked to 4 – 6% approximately by drawing or reduction to ensure a high quality of the pipe surface.

The known methods of manufacture of seamless steel pipes which stipulate the manufacturing conditions only by a 50% reduction as stated in the British patent fail to product vacuum-tight capillary pipes with a high tightness reaching 100%.

At present, owing to a wide diversity of operating conditions of diffusion hydrogen filters (metallic semi-permeable membranes) it turns out to be most practicable to use palladium alloys possessing a number of special properties such as high hydrogen permeability and resistance along with a good combination of mechanical properties.

However, the known methods of manufacturing seamless pipes are unsuitable for making palladium alloy seamless capillary pipes which would be thin-walled, highly vacuum-tight and suitable for use in the capacity of diffusion filters for producing ultra-pure hydrogen or its isotopes.

It is an object of the present invention to provide a method of manufacturing seamless capillary from palladium-based alloys which would be thin-walled and vacuum-tight.

This object is achieved by manufacturing seamless capillary thin-walled vacuum-tight pipes from palladium alloys, according to the present invention, by drawing and reducing the pipe billet by stages so that the cross-sectional area of the billet walls decreases at each stage by 60 – 80%, each drawing stage being followed by annealing said billet at 830°±30°; then, as the thickness of pipe walls decreases to 0.24 – 0.30 mm, the billet is again drawn and reduced by stages so as to decrease the cross sectional area of the pipe walls by 28 – 50% at each stage, each drawing stage being followed by annealing at 750°±20°C.

This method produces seamless capillary thin-walled vacuum-tight pipes from palladium alloys which withstand a vacuum of $10^{-3}$ - $10^{-4}$ mm Hg and stay vacuum-tight after 1000 hr of operation in hydrogen-containing media.

Other objects and advantages of the present invention will be understood from the detailed description of the method of manufacture of seamless capillary thin-walled vacuum-tight pipes and from examples of its realization.

The technological procedure begins with making an ingot from a palladium-based alloy in an electric-arc furnace with a consumable electrode, The alloy may be any palladium-based alloy including alloys used for making diffusion hydrogen filters. For example, a palladium-based alloy containing silver, gold, platinum, ruthenium and aluminum (the U.S. Pat. No. 3,804,616 Cl.55-16, the British patent specification No. 1,365,271 Cl.C7A); a palladium-based alloy containing silver, yttrium and indium (the USSR Inventor's Certificate No. 463729); a palladium-based alloy containing silver, indium, yttrium and one or more elements from the group containing molybdenum, tungsten, niobium, tantalum (Application No. 207391/22-1 filed in the USSR Patent Office); a palladium-based alloy containing silver and nickel (the USSR Inventor's Certificate No. 182698). Other palladium-based alloys can be used too. Said ingot is used for making pipe billets with a through hole inside. For example, a 12-kg ingot is made into two billets of 76 mm diameter with a through hole of 32 mm diameter. Then these billets are pressed into tubular billets on, say, a 600-ton vertical hydraulic press with an independent piercing device.

These tubular billets are cold-drawn on chain drawing mills with a drawing pull of 5 tf, 1.5 tf, 0.2 tf.

The process of drawing is carried out by conventional methods through pobedite rings with the use of an emulsion compound. After several passes, when the cross-sectional area decreases to the preset limit the pipe is annealed and then drawn again.

According to the present invention, the object of the invention i.e. production of seamless capillary thin-walled vacuum-tight pipes from palladium alloys is achieved by stipulating the degrees of reduction (i.e. decrease of the pipe cross-sectional area) and the subsequent annealing operations depending on the thickness of the pipe wall. First (in one or more passes which depends on the initial dimensions of the pipe billet and the characteristics of the pipe-drawing mill) the initial pipe billet with a diameter usually exceeding 10 - 30 mm and a wall thickness exceeding 1 - 2 mm is drawn in such a manner as to decrease its cross-sectional area by 60 - 80%. An increase in the extent of reduction over 80% impairs the vacuum-tightness of the product whereas a reduction under 60% fails to ensure sufficient compacting of the material.

On reaching said deformation of 60 - 80% the pipe is annealed at 830°±30° C. At this temperature the pipe material, i.e. palladium-based alloy, is subjected to recrystallization annealing which restores its plastic properties to such an extent that the pipe can again be deformed by drawing. An increase in the annealing temperature above 860° C results in an intensive growth of grain and loss of the requisite plastic properties which leads to loss of vacuum-tightness during subsequent drawing. A decrease in the annealing temperature below 800° C fails to restore the plastic properties of the pipe with a wall thickness exceeding 0.3 mm which hampers subsequent machining and reduces the yield of quality pipes.

The above operations, i.e. drawing with reduction by 60 - 80% followed by annealing at 830°±30° C are repeated until the thickness of the pipe wall reaches critical values equal to 0.24 - 0.30 mm. On reaching this wall thickness limit the deforming ability of the pipe made from palladium alloys and its ability to restore its plasticity during annealing are changed.

Said critical wall thickness (0.24 - 0.30 mm) has been found experimentally and is explained by the fact that it changes the interdependence between the structure of the palladium-based alloys and their ability for plastic flow during drawing. Beginning from this critical value the total degree of reduction must be substantially decreased and so must the temperature of interstage annealing which will ensure better fineness of grain of the material and its vacuum tightness during subsequent processing.

Accordingly, on reaching the critical thickness of the pipe wall the conditions of drawing and interstage annealing must be changed. If this requirement is not satisfied and the conditions of drawing and annealing are changed at a wall thickness above 0.30 mm or below 0.24 mm, further processing is hindered and the yield of sound pipes is sharply reduced due to poor vacuum-tightness. Extra-thin-walled capillary pipes from palladium alloys in this case cannot be produced at all.

Thus, on reaching the critical thickness of the pipe wall (0.24 - 0.30 mm) the conditions of drawing and interstage annealing of the pipes made from palladium-based alloys change as follows.

The pipe is now drawn by one or more stages so as to decrease its cross sectional area by 28 - 50%, and annealed at 750°±20° C. Then these operations are repeated until the pipe acquires the predetermined dimensions.

Failure to observe the above conditions of drawing of a thin-walled pipe made from palladium-based alloys or the prescribed temperature of annealing results in non-reversible changes in metal structure and impairs the vacuum-tightness of the pipe. The yield of sound pipes drops sharply whereas ultra-thin-walled capillary vacuum-tight pipes from palladium alloys at deformation exceeding 50% (or under 28%) and annealed at temperatures above 770° C (or below 730° C) cannot be produced at all.

Thus, the method according to the invention stipulates the degrees of pipe reduction during drawing and the temperatures of interstage annealing depending on the thickness of the pipe wall. At first, when the wall of the pipe billet exceeds the critical thickness (0.24 - 0.30 mm) it is drawn and reduces so as to decrease the cross sectional area of the walls by 60 - 80% with interstage annealing at 803°±30° C; then, as soon as the thickness of the pipe wall is reduced to 0.24 - 0.30 mm, such a pipe is drawn and reduced so as to decrease the cross sectional area of the pipe by 28 - 50% and is annealed between successive stages at 750°±20° C.

The method according to the invention ensures the manufacture of seamless capillary thin-walled vacuum-tight pipes from palladium alloys suitable for use as diffusion filters for hydrogen and its isotopes. The pipes with such properties can be available in diameters of 2.5 mm and below and a wall thickness of 0.12 mm and below.

The above-listed palladium-based alloys were used for manufacturing pipes of the following actual dimensions: diameter 2.5 mm, wall thickness 0.12 mm; diameter 1.2 mm, wall thickness 0.12 mm; diameter 0.9 mm, wall thickness 0.05 mm; diameter 0.5 mm, wall thickness 0.05 mm. The vacuum-tightness tests of the pipes manufactured by the method according to the invention have shown a 100% yield of high-quality pipes.

The finished pipes have also been tested on a durability test stand for diffusion hydrogen filters. The tests have proved that the seamless capillary thin-walled pipes made from palladium-based alloys are suitable for producing a vacuum of $10^{-3}$ - $10^{-4}$ mm Hg and higher. The vacuum-tightness is not impaired after 1000 hr of operation in hydrogen-containing gaseous media.

The capillary pipes have been used to make a high-pressure diffusion hydrogen filter and have shown that they can withstand pressures up to 300 atm gauge without any kind of reinforcement and without loss of vacuum-tightness.

Thus, the method according to the invention ensures the manufacture of high-quality seamless thin-walled capillary vacuum-tight pipes from palladium-based alloys.

EXAMPLE 1

An alloy consisting of 5.5 wt.% nickel, 10 wt.% silver and 84.5 wt.% palladium is melted in an electric arc furnace with a consumable electrode. The produced 12-kg ingot is transformed into two billets of 76 mm diameter with a through hole of 32 mm diameter. Then the billets are reworked on a hydraulic press into tubular billets of 36 mm diameter with a wall thickness of 3.5 mm. Then, according to the present invention, the tubular billet is drawn with reduction and annealed in the following sequence of operations.

1. The billet is drawn and reduced to decrease its diameter from 36 mm to 24 mm and its wall thickness from 3.5 mm to 2 mm (total deformation 62%). Then the deformed product is annealed in a shielding atmosphere at 800°±30° C.

2. The pipe produced during the first stage is drawn and reduced to decrease its diameter and wall thickness to 11 mm and 0.9 mm respectively (total deformation 80%). Then the product is annealed at 800°C ±30° C. in a shielding atmosphere.

3. The pipe produced during the second stage is drawn and reduced to decrease its diameter and wall thickness to 5 mm and 0.5 mm, respectively (total deformation 75%) and annealed at 800°±30° C in a shielding atmosphere.

4. The pipe produced during the third stage is drawn and reduced to decrease its diameter and wall thickness to 3.3 mm and 0.3 mm respectively (total deformation 60%) and annealed at 750°±20° C in a shielding atmosphere.

5. The pipe produced during the fourth stage is drawn and reduced to decrease its diameter to 2.9 mm and wall thickness to 0.17 mm (total deformation 50%) and annealed at 750°±20° C in a shielding atmosphere.

6. The pipe produced during the fifth stage is drawn and reduced to decrease its diameter and wall thickness to 2.5 mm and 0.12 mm (total reduction 39%).

The finished pipes are tested for vacuum-tightness as follows. During individual manufacturing stages the pipes are plugged at one end, filled with compressed air at 3 atm gauge and dipped entirely into water for spotting any defects impairing the integrity of metal. The tests have proved a 100% yield of sound pipes made by the method according to the invention.

The finished pipes have also been tested on a durability test stand of diffusion hydrogen filters. The tests have proved that it is possible to produce a vacuum of $10^{-3}$ - $10^{-4}$ mm Hg and higher in seamless capillary thin-walled pipes made from palladium alloys. The vacuum tightness is retained in the course of 1000 hr of operation of hydrogen-containing gas media.

Capillary pipes have been used for making a high-pressure hydrogen diffusion filter and it turned out that the pipes withstand a pressure of up to 300 atm gauge without any reinforcement and without loss of vacuum.

EXAMPLE 2

An alloy containing silver, gold, platinum, ruthenium and aluminum (see the U.S. Pat. No. 3,804,616) is melted in an electric-arc furnace with a consumable electrode. Then tubular billets are pressed from this alloy on a 600 tf vertical hydraulic press with a non-clamping piercing device.

1. A pipe billet 28 mm in a diameter with a wall thickness of 2.5 mm is drawn and reduced to decrease its diameter and wall thickness to 17 mm and 0.9 mm, respectively (total deformation 77%). Then the billet is annealed at 800° C in the course of 30 minutes in a shielding atmosphere.

2. The pipe produced during the first stage is drawn and reduced to decrease its diameter and wall thickness to 6 mm and 0.75 mm, respectively. Then it is annealed at 800° C in the course of 30 minutes in a shielding atmosphere.

3. The pipe produced during the second stage is drawn and reduced to decrease its diameter and wall thickness to 3.68 mm and 0.24, respectively (total deformation 79%). Then the pipe is annealed at 750° C in the course of 45 minutes in a shielding atmosphere.

4. The pipe produced during the third stage is drawn and reduced so as to decrease its diameter and wall thickness to 3.2 mm and 0.15 mm, respectively (total deformation 45%). Then the pipe is annealed at 750° C in the course of 45 minutes in a shielding atmosphere.

5. The pipe produced during the fourth stage is drawn and reduced to decrease its diameter and wall thickness to 2.5 mm and 0.12 mm, respectively (total deformation 50%). Then it is annealed at 750° C for 45 min in a shielding atmosphere.

6. The pipe produced during the fifth stage is drawn and reduced to decrease its diameter and wall thickness to 1.9 mm and 0.12 mm respectively (total deformation 28%). Then it is annealed at 750° C in a shielding atmosphere.

7. The pipe produced during the preceding stage is drawn and reduced to decrease its diameter and wall thickness to 1.2 mm and 0.12 mm, respectively (total deformation 38%).

The tightness tests of the manufactured seamless capillary thin-walled pipes have shown a 100% yield of sound pipes.

EXAMPLE 3

A tubular billet of 28 mm diameter with a wall thickness of 2.5 mm is made from a palladium-based alloy as described in Example 2.

1. Said billet is drawn and reduced to decrease its diameter and wall thickness to 17 mm and 0.9 mm, respectively (total deformation 77%). Then the billet is annealed at 800° C for 30 min in a shielding atmosphere.

2. The pipe produced during the 1st stage is drawn and reduced to decrease its diameter and wall thickness to 6 mm and 0.75 mm respectively (total deformation 87%). Then it is annealed at 800° C for 30 min in a shielding atmosphere.

3. The pipe produced during the second stage is drawn and reduced to decrease its diameter and wall thickness to 3.68 mm and 0.24 mm, respectively (total deformation 94%).

The tests of the semifinished product produced in this manner and described in the present invention have shown that drawing of pipes with a reduction exceeding 80% has yielded about 30% of leaky pipes.

EXAMPLE 4

A tubular billet of 28 mm diameter with a wall thickness of 2.5 mm is made from a palladium-based alloy as described in Example 2.

The tubular billet is drawn and reduced as described in stages 1, 2, 3 of Example 2. However, annealing after each drawing stage with reduction is performed at the following temperatures: 1000° C after the first stage; 900° C after the second stage; after the third stage of drawing with reduction there was no annealing but the pipe was tested for tightness. The test has proved that at a higher annealing temperature 25% of the semifinished pipes according to the present invention are leaky.

EXAMPLE 5

A seamless capillary thin-walled pipe is made as described in Example 2. However, after the third manufacturing stage the pipe is drawn and reduced so that its diameter and wall thickness are decreased to 3.2 mm and 0.15 mm (total deformation 45%). Then the pipe is annealed at 750° C in a shielding atmosphere.

After the fourth stage the pipe is drawn with reduction to decrease its diameter and wall thickness to 2.5 mm and 0.12 mm, respectively (total deformation 53%). Then it is annealed at 750° C in a shielding atmosphere.

The pipe produced during the preceding manufacturing stage is drawn and reduced to change its diameter and wall thickness to 1.2 mm and 0.12 mm respectively (total deformation 53%).

The tightness tests have shown that 60% of the total number of manufactured pipes are leaky.

EXAMPLE 6

Seamless capillary thin-walled pipes made for a palladium-based alloy are manufactured as described in Example 5 but the interstage annealing after the 4th, 5th and 6the stages is carried out at 830° C.

The tests revealed a high percentage of waste and poor tightness in 35% of the produced pipes.

What we claim is:

1. A method of manufacture of seamless capillary thin-walled vacuum-tight pipes from palladium-based alloys characterized in that a pipe billet is drawn and reduced by stages so that each time the cross sectional area of the billet walls decreases by 60 – 80% and each drawing stage is followed by annealing said billet at 830°±30° C; then, after decreasing the thickness of pipe walls to 0.24 – 0.30 mm the billet is again drawn and reduced by stages, each time decreasing the cross sectional area of the pipe walls of 28 – 50% and annealing the pipe at 750°±20° C after each drawing stage.

* * * * *